US008657036B2

(12) United States Patent
Barron et al.

(10) Patent No.: US 8,657,036 B2
(45) Date of Patent: Feb. 25, 2014

(54) TUBING SHOE

(75) Inventors: William Barron, Aberdeen (GB); Ian Kirk, Aberdeen (GB)

(73) Assignee: Downhole Products Limited, Aberdeen (GB)

( * ) Notice: Subject to any disclaimer, the term of this patent is extended or adjusted under 35 U.S.C. 154(b) by 237 days.

(21) Appl. No.: 13/143,362

(22) PCT Filed: Jan. 14, 2010

(86) PCT No.: PCT/GB2010/050046
§ 371 (c)(1),
(2), (4) Date: Sep. 2, 2011

(87) PCT Pub. No.: WO2010/082051
PCT Pub. Date: Jul. 22, 2010

(65) Prior Publication Data

US 2011/0308813 A1 Dec. 22, 2011

(30) Foreign Application Priority Data

Jan. 15, 2009 (GB) ..... 0900606.5

(51) Int. Cl.
*E21B 17/14* (2006.01)

(52) U.S. Cl.
USPC ..... 175/57; 175/402

(58) Field of Classification Search
USPC ..... 175/57, 402
See application file for complete search history.

(56) References Cited

U.S. PATENT DOCUMENTS 1,970,761 A 8/1934 McVicar
2,136,748 A 11/1938 McVicar
2,196,528 A 4/1940 Hughes
2,207,920 A 7/1940 Hughes
2,215,913 A 9/1940 Brown
2,331,293 A 10/1943 Ballard
2,334,746 A 11/1943 Brantly (Continued)

FOREIGN PATENT DOCUMENTS

EP 0418706 A1 3/1991
GB 1153988 A 6/1969

(Continued)

OTHER PUBLICATIONS

Morrish, Susan, "International Search Report", for PCT/GB2010/050046, as mailed Sep. 28, 2010, 3 pages.
PCT International Search Report and Written Opinion cited in Application No. PCT/US2010/037330, dated Aug. 5, 2010 (8 pages).

(Continued)

*Primary Examiner* — William P Neuder
(74) *Attorney, Agent, or Firm* — Winstead PC

(57) ABSTRACT

A tubing shoe is disclosed with a body adapted to be connected to a section of tubing to be emplaced in a wellbore and a nose provided on the body, wherein the nose includes a failure guide structure for controlling break-up of the nose upon being drilled out from inside the nose. The failure guide structure typically controls break up by limiting the maximum size of pieces of the nose broken off upon drill out, for example, by defining weakened areas of the nose which are prone to failure upon drilling. The failure guide structure can include discontinuities such as slots or bores formed or drilled into the outer surface of the nose. The failure guide structure controls the break up of the nose in a consistent and predictable manner, and typically at a predictable stage during the drill-out process.

22 Claims, 6 Drawing Sheets

(56) References Cited

U.S. PATENT DOCUMENTS

| | | | |
|---|---|---|---|
| 2,357,330 | A | 9/1944 | Hyer |
| 2,492,794 | A | 12/1949 | Goble et al. |
| 2,493,178 | A | 1/1950 | Williams, Jr. |
| 2,495,439 | A | 1/1950 | Brimble |
| 2,642,267 | A | 6/1953 | Zublin |
| 2,644,672 | A | 7/1953 | Mathews |
| 2,658,284 | A | 11/1953 | Jacob |
| 2,669,429 | A | 2/1954 | Zublin |
| 2,869,825 | A | 2/1954 | Crawford |
| 2,708,105 | A | 5/1955 | Williams, Jr. |
| 3,266,577 | A | 8/1966 | Turner |
| 3,536,150 | A | 10/1970 | Stebley |
| 4,101,318 | A | 7/1978 | Rudy |
| 4,351,401 | A | 9/1982 | Fielder |
| 4,382,477 | A | 5/1983 | Barr |
| 4,478,298 | A | 10/1984 | Hake et al. |
| 4,605,343 | A | 8/1986 | Hibbs, Jr. et al. |
| 4,623,025 | A | 11/1986 | Verstraeten |
| 4,696,354 | A | 9/1987 | King et al. |
| 4,714,120 | A | 12/1987 | King |
| 4,794,986 | A | 1/1989 | Langer |
| 4,815,342 | A | 3/1989 | Brett et al. |
| 4,823,892 | A | 4/1989 | Fuller |
| 4,869,330 | A | 9/1989 | Tibbitts |
| 4,889,017 | A | 12/1989 | Fuller et al. |
| 4,956,238 | A | 9/1990 | Griffin |
| 5,042,596 | A | 8/1991 | Brett et al. |
| 5,090,492 | A | 2/1992 | Keith |
| 5,127,923 | A | 7/1992 | Bunting et al. |
| 5,244,039 | A | 9/1993 | Newton, Jr. et al. |
| 5,259,469 | A | 11/1993 | Stjernstrom et al. |
| 5,330,016 | A | 7/1994 | Paske et al. |
| 5,346,025 | A | 9/1994 | Keith et al. |
| 5,358,026 | A | 10/1994 | Simpson |
| 5,441,121 | A | 8/1995 | Tibbitts |
| 5,549,171 | A | 8/1996 | Mensa-Wilmot et al. |
| 5,551,522 | A | 9/1996 | Keith et al. |
| 5,582,261 | A | 12/1996 | Keith et al. |
| 5,651,421 | A | 7/1997 | Newton et al. |
| 5,797,455 | A | 8/1998 | Barron et al. |
| 5,826,651 | A | 10/1998 | Lee et al. |
| 5,887,668 | A | 3/1999 | Haugen et al. |
| 5,979,571 | A | 11/1999 | Scott et al. |
| 6,039,127 | A | 3/2000 | Myers |
| 6,062,326 | A | 5/2000 | Strong et al. |
| 6,063,502 | A | 5/2000 | Sue et al. |
| 6,138,756 | A | 10/2000 | Dale |
| 6,145,607 | A | 11/2000 | Griffin et al. |
| 6,298,930 | B1 | 10/2001 | Sinor et al. |
| 6,401,820 | B1 | 6/2002 | Kirk et al. |
| 6,439,326 | B1 | 8/2002 | Huang et al. |
| 6,443,247 | B1 | 9/2002 | Wardley |
| 6,460,631 | B2 | 10/2002 | Dykstra et al. |
| 6,464,002 | B1 | 10/2002 | Hart et al. |
| 6,510,906 | B1 | 1/2003 | Richert et al. |
| 6,568,881 | B2 | 5/2003 | Long |
| 6,612,383 | B2 | 9/2003 | Desai et al. |
| 6,612,384 | B1 | 9/2003 | Singh et al. |
| 6,620,308 | B2 | 9/2003 | Gilbert |
| 6,655,481 | B2 | 12/2003 | Findley et al. |
| 6,659,173 | B2 | 12/2003 | Kirk et al. |
| 6,702,045 | B1 | 3/2004 | Elsby |
| 6,725,939 | B2 | 4/2004 | Richard |
| 6,817,633 | B2 | 11/2004 | Brill et al. |
| 6,845,816 | B2 | 1/2005 | Kirk et al. |
| 6,848,517 | B2 | 2/2005 | Wardley |
| 7,066,253 | B2 | 6/2006 | Baker |
| 7,096,982 | B2 | 8/2006 | McKay et al. |
| 7,117,960 | B2 | 10/2006 | Wheeler et al. |
| 7,216,727 | B2 | 5/2007 | Wardley |
| 7,322,776 | B2 | 1/2008 | Webb et al. |
| 7,395,882 | B2 | 7/2008 | Oldham et al. |
| 7,426,969 | B2 | 9/2008 | Azar |
| 7,757,793 | B2 | 7/2010 | Voronin et al. |
| 7,998,573 | B2 | 8/2011 | Qian et al. |
| 8,074,749 | B2 | 12/2011 | Twardowski et al. |
| 2002/0170713 | A1 | 11/2002 | Haugen et al. |
| 2004/0108739 | A1 | 6/2004 | Beeman et al. |
| 2004/0188141 | A1 | 9/2004 | Slaughter et al. |
| 2004/0226751 | A1 | 11/2004 | McKay et al. |
| 2004/0228694 | A1 | 11/2004 | Webb et al. |
| 2004/0244540 | A1 | 12/2004 | Oldham et al. |
| 2004/0245020 | A1 | 12/2004 | Giroux et al. |
| 2005/0103530 | A1 | 5/2005 | Wheeler et al. |
| 2005/0145417 | A1 | 7/2005 | Radford et al. |
| 2006/0070771 | A1 | 4/2006 | McClain et al. |
| 2006/0124706 | A1 | 6/2006 | Raybould et al. |
| 2007/0131459 | A1 | 6/2007 | Voronin et al. |
| 2007/0175671 | A1 | 8/2007 | Nava |
| 2007/0175672 | A1 | 8/2007 | Eyre et al. |
| 2007/0187149 | A1 | 8/2007 | Kristensen et al. |
| 2007/0193782 | A1 | 8/2007 | Fang et al. |
| 2007/0246224 | A1 | 10/2007 | Krauss et al. |
| 2007/0261890 | A1 | 11/2007 | Cisneros |
| 2007/0277651 | A1 | 12/2007 | Calnan et al. |
| 2007/0278017 | A1 | 12/2007 | Shen et al. |
| 2007/0289782 | A1 | 12/2007 | Clark et al. |
| 2008/0149398 | A1 | 6/2008 | Azar |
| 2008/0187403 | A1 | 8/2008 | Ertl et al. |
| 2009/0078470 | A1 | 3/2009 | Lyons et al. |
| 2009/0120693 | A1 | 5/2009 | McClain et al. |
| 2009/0255664 | A1 | 10/2009 | Hart et al. |
| 2010/0051349 | A1 | 3/2010 | Ballard et al. |
| 2010/0166592 | A1 | 7/2010 | Uno et al. |
| 2010/0282519 | A1 | 11/2010 | Zhang et al. |
| 2010/0307837 | A1 | 12/2010 | King et al. |
| 2011/0061941 | A1 | 3/2011 | Twardowski et al. |
| 2011/0209922 | A1* | 9/2011 | King et al. ..... 175/402 |
| 2011/0259604 | A1 | 10/2011 | Oldham et al. |
| 2011/0259605 | A1 | 10/2011 | Oldham et al. |
| 2011/0259606 | A1 | 10/2011 | Oldham et al. |
| 2011/0259608 | A1 | 10/2011 | Oldham et al. |
| 2011/0259643 | A1 | 10/2011 | Oldham et al. |
| 2011/0266069 | A1 | 11/2011 | Oldham et al. |
| 2012/0103694 | A1 | 5/2012 | Twardowski et al. |

FOREIGN PATENT DOCUMENTS

| | | | |
|---|---|---|---|
| GB | 2369633 | A | 6/2002 |
| GB | 2339227 | A | 11/2002 |
| GB | 2429731 | A | 8/2008 |

OTHER PUBLICATIONS

Hughes Christensen, "Reduce Risk, Ensure your casing gets to total depth", EZReam, Baker Hughes Inc, 2007 (4 pages).

"DrillShoe III, Drilling with Casing", Weatherford International Ltd., 2005-2008 (4 pages).

"DrillShoe II, 5-Blade Models, Drilling with Casing", Weatherford International Ltd., 2008 (4 pages).

"DrillShoe II, 4-Blade Models, Drilling with Casing", Weatherford International Ltd., 2005-2007 (4 pages).

Sinor, Allen: "Casing Drilling—Recent Advances for Drilling Challenges," Hughes Christensen—A Baker Hughes Company, The Woodlands, TX, SPE Gulf Coast Section Jan. 10, 2001 (34 pages).

Office Action mailed Oct. 13, 2006 for U.S. Appl. No. 10/783,720 (27 pages).

Office Action mailed Apr. 20, 2006 for U.S. Appl. No. 10/783,720 (32 pages).

Tarr, Brian, et al.: "Casing-while-Drilling: The Next Step Change in Well Construction," Published in World Oil, Oct. 1999 issue (10 pages).

Sinor, L.A., et al.: "Rotary Liner Drilling for Depleted Reservoirs," IADC/SPE 39399, Mar. 3-6, 1998 (10 pages).

Galloway G.: "Rotary Drilling with Casing—A field proven method of reducing wellbore construction cost," World Oil Casing Drilling Technical Conference, Mar. 6-7, 2003 (7 pages).

McKay, D., et al.: "New Developments in the Technology of Drilling with Casing: Utilizing a Displaceable DrillShoe Tool," World Oil Casing Drilling Technical Conference, Mar. 6-7, 2003 (11 pages).

PCT International Preliminary Report on Patentability mailed Dec. 15, 2011 for PCT/US2010/037330 (7 pages).

Chinese First Office Action for 201080019941.X mailed Jul. 30, 2013 (13 pages).

* cited by examiner

TUBING SHOE

The present invention relates to a tubing shoe, and in particular, but not exclusively, to liner shoe or a casing shoe for use in the downhole environment in wellbores.

A tubing shoe is typically used to help emplace tubular casing sections or liners in a desired section of a wellbore, and is widely used in the oil and gas exploration and production industry.

A tubing shoe is typically connected to the leading end of a string of tubing to be emplaced in the well, and has a nose which is shaped, typically tapered, to push aside deposits and debris and fluids as it is run down hole into the wellbore. It is typically formed with a thickened tip so that it is strong enough to remain intact while the tubing is being inserted into the well, and to withstand impacts from debris and or other components in the wellbore.

When a required wellbore depth is reached during a drilling phase, the newly drilled borehole is normally lined with metal tubing, such as casing or liner. The tubing is usually formed from discrete lengths which are connected end to end in a string as the tubing is run into the borehole. When the bottom of the tubing string reaches the end of the drilled section, or the required depth for the tubing, the string is installed at that location by introducing cement to an annular space formed between an outer surface of the tubing string and the inner wall of the borehole. The inner wall of the borehole can be the newly drilled formation, or it can comprise a section that was lined in an earlier operation. The cement is typically pumped under pressure from the surface down through the inside of the tubing string and emerges through a flow passage of the tubing shoe into the borehole. Due to the applied pressure, the cement flows out of the nose and up towards the surface along the outside of the tubing string in the annular space surrounding the tubing and is left to set thereby securing the tubing string in place. The tubing seals the borehole, prevents the formation walls from collapsing into the bore, and provides a lined hole of consistent diameter through which equipment can be introduced in controlled conditions to carry out later stage operations in the well.

After the tubing is positioned as described above, a drill string may be inserted through the inner bore of the tubing and used to drill out through the nose of the shoe so that it can access, through the tubing, the open formation at the bottom of the hole, and drill a further section of the well.

As it is drilled through, the nose breaks up and the thickened tip of the nose typically falls off as a single large block, into the well. This can be problematic because large blocks of this nature may interfere with the cutting function of the drill bit, and in some cases may act as a low-friction bearing for the bit so that it is prevented from engaging properly to cut into the formation.

According to a first aspect of the invention there is provided a tubing shoe comprising:

- a body adapted to be connected to a section of tubing to be emplaced in a wellbore; and
- a nose provided on the body;
- wherein the nose includes a failure guide structure for controlling break-up of the nose upon being drilled out from inside the nose.

The failure guide structure is adapted to fail during drilling, typically resulting in a reduction in the strength of the nose, and typically facilitating rapid break up of the nose in a consistent and predictable manner, typically at a predictable stage during the drill-out process.

Typically, the nose is adapted to be drilled out from inside the nose.

The nose can be provided at the end of the body.

The nose can be eccentric.

The failure guide structure may be adapted to control break up by limiting the maximum size of pieces of the nose broken off upon drill out. The failure guide structure may facilitate fracture, optionally by defining weakened areas of the nose which are prone to failure upon drilling.

More specifically, the failure guide structure may include at least one discontinuity formed in a wall of the nose, for facilitating failure of the nose in the region of the discontinuity when the nose is drilled. Optionally, the failure guide structure has a plurality of such discontinuities formed in the wall of the nose.

The failure guide structure can be provided at the outer end of the nose wall (e.g. at the outer surface).

The discontinuities may be formed by the removal of material from the wall of the nose, and can be in the form of slots, bores, partial bores, punctures and/or perforations or the like. One or more such discontinuities may extend from an outer surface of the nose. Alternatively or in addition, one or more of the discontinuities may extend from an inner surface of the nose.

The discontinuities may extend from an opening provided in the inner or outer surfaces and may define a gap or cavity in the wall of the nose.

In certain embodiments, one or more of the discontinuities may extend through the wall of the nose, for example in the form of a throughbore.

In some embodiments, one or more of the discontinuities may extend a certain distance into the nose wall, without reaching across to the other side of the wall.

One or more discontinuities may be blind ended bores, typically extending from the outside of the shoe toward the inside. One advantage of arranging at least some of the discontinuities in this way is that the inner surface of the shoe is then stronger than the outer surface of the shoe, and so the relatively stronger inner surface holds the shoe intact through the insertion process. However, when the nose of the shoe is drilled from the inside out, the break up of the nose occurs in a predictable manner, when the drill bit reaches (e.g. the blind end of) one or more discontinuities. Optionally, the drill bit reaching this depth in the nose of the shoe can interconnect all discontinuities having the same depth of blind ended bore. The resulting reduction in the strength of the nose can cause relatively rapid break up of the nose in a consistent and predictable manner, and at a predictable stage during the drill-out process.

The one or more discontinuities may be arranged to define or delimit sub-regions of the nose, for example prismatic sub-blocks bounded, at least in part, by one or more of the discontinuities. One or more discontinuities can be arranged at the borders or apexes of the sub regions, e.g. at the corners. The nose is thereby adapted or pre-disposed for preferred break-up into pieces of a size dependent on, determined by and/or corresponding to the size of the sub-regions. The discontinuities can be aligned in straight or arcuate lines to define the sub-regions.

The tubing shoe is typically provided with one or more flow ports, and one or more discontinuities may be provided in a portion of the wall of the nose located between flow ports.

The tubing shoe and/or the nose may be provided with cutting or milling blades or surfaces, and one or more discontinuities may be provided between blades.

The nose may be connected to the body of the tubing shoe at a fixing point, for example, via engaging pins or a screw thread. One or more discontinuities may be provided in a wall of the nose in a region between fixing points. One or more discontinuities may be provided in the wall of the nose in a region between any one of a flow port, a fixing point or a blade.

Alternatively or in addition, one or more discontinuities may typically be provided in the wall of the nose in a region between the tip of the nose and any one or more flow ports, cutting blades, and/or fixing points.

One or more of the discontinuities may have an axis substantially parallel to and coincident with a longitudinal axis of the tubing shoe. Typically, one or more of the discontinuities may have an axis which is substantially parallel to and spaced apart from the longitudinal axis.

Alternatively or in addition, one or more of the discontinuities may have axes, for example longitudinal axes of bores, which are inclined with respect to the longitudinal axis of the tubing shoe, or with respect to the axes of other discontinuities. Axes of one or more of the discontinuities may be oriented along intersecting directions. Two or more of the discontinuities may be interconnected.

Where there is a plurality, the discontinuities may be arranged in groups or sub-sets of discontinuities. Each group or subset of discontinuities may have a characteristic kind, length, orientation, position, such as referred to above in relation to the one or more discontinuities in their own right, and the characteristic may be consistent or form a set relationship between members of the subset or group.

In one embodiment, a sub-set has discontinuities spaced apart on a straight or curved line, for example, around a circumference of the nose. Alternatively or in addition, a sub-set may have a series of discontinuities spaced evenly or unevenly apart along on a straight line in cross-section across at least part of the nose. The failure guide structure may include a plurality of such lines, wherein one line is angled with respect to a second line. Each sub-set may be associated with a particular cross-sectional plane intersecting the nose, and each subset may have a different spacing.

In one embodiment, one or more discontinuities may be spaced evenly or unevenly apart along on an arcuate line in cross-section across at least part of the nose. The failure structure may include a plurality of such lines, wherein one line is angled with respect to a second line, for example, such that their axes intersect. Each sub-set may be associated with a particular cross-sectional plane intersecting the nose, and each subset may have a different spacing.

The nose may be tapered, and typically has conical or frustoconical shape. The nose is typically formed from a metal, such as aluminium or other like materials which are sufficiently strong to withstand exposure to the borehole environment, but which can be drilled out using a standard drill bit when required.

One or more discontinuities may be spaced apart from each other around a circumference of the nose and a different spacing may be adopted between discontinuities according to the circumferential length, thus, the circumferential spacing between discontinuities may not be consistent within the group and may reduce as the nose tapers toward the tip.

The nose may have a hollow nose body having an inner surface defining one or more steps. The surface is configured to be drilled by a drill bit for drill out of the nose, and the steps may present a high-pressure contact point or area for contact with the drill bit. In embodiments where the discontinuities include partial bores, the partial bores are located between an outer surface of the nose and the inner wall. The partial bore may be positioned radially to align with the steps and/or step corners and/or step edges or faces of the inner surface, and/or the partial bores may be positioned with an end of the partial bore spaced a pre-determined distance from the internal wall and/or step. This configuration allows break up of the nose to be readily initiated on engagement of the drill bit, and provides a short distance between the ends of the bore and the inner surface allowing the one or more bores to readily influence the manner of break up at the early stages of being drilled out. Some or all of the bores may have a different depth, width, length, and/or cross-sectional shape.

In some embodiments, discontinuities may extend through the nose wall, and the failure guide structure may further include a fracture web, which initially may hold together separable sub-blocks of the nose wall, such as may be defined by the discontinuities. The fracture web may be adapted to be engaged by a drill bit directly or indirectly via another surface to fracture and release the sub-blocks when drilled out. The fracture web may be a mesh structure separating blocks of the nose wall whilst holding the blocks in place until drilled out. The mesh structure may be formed from a different material to the nose material, and which may have favourable fracture characteristics, for example a shattering characteristic, to facilitate release of the blocks.

According to a second aspect of the invention, there is provided a method of drilling a wellbore, the method comprising:

a. coupling a tubing shoe having a nose with failure guide structure to a tubing string;
b. running the string into a well to an installation location;
c. drilling out through the nose of the tubing shoe into the wellbore formation; and
d. controlling break up of the nose via the failure guide structure.

The method may include forming one or more discontinuities in the nose of the tubing shoe.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention.

Various embodiments and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of, "consisting", "selected from the group of consisting of", "including", or "is" preceding the recitation of the composition, element or group of elements and vice versa.

All numerical values in this disclosure are understood as being modified by "about". All singular forms of elements, or any other components described herein including (without limitations) components of the apparatus to collect cuttings are understood to include plural forms thereof and vice versa.

Figure 5:
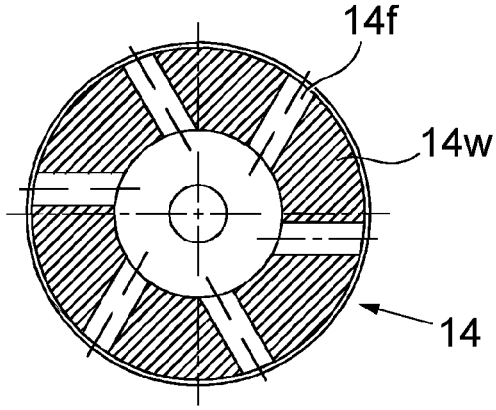
FIG. 5 is a cross-sectional view along the line A-A' of FIG. 1.
Figure 6:
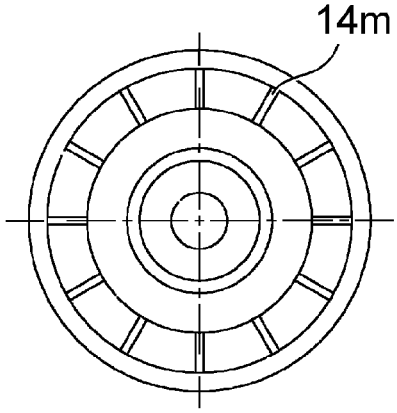
FIG. 6 is a cross-sectional view along the line B-B' of FIG. 1.
Figure 12:
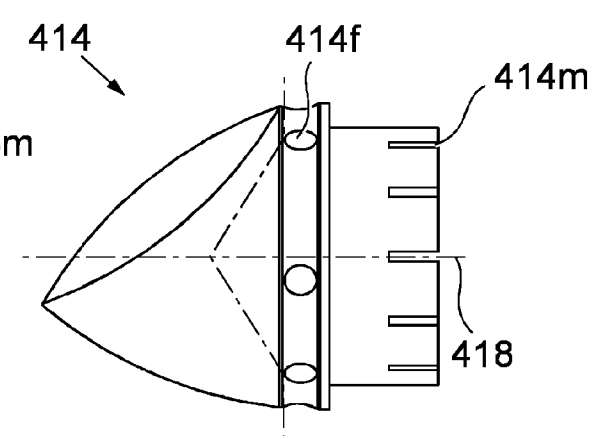
Figure 11:
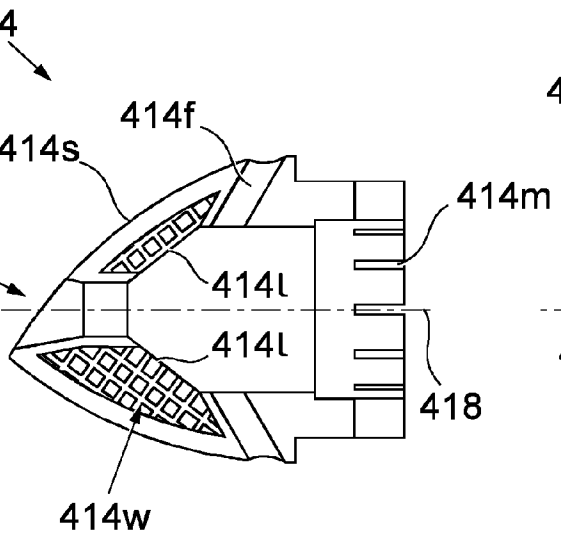
Figure 10:
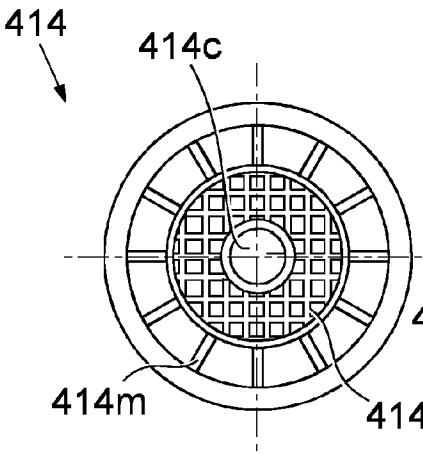

FIGS. 10 and 11 are views similar to FIGS. 5 and 6 of a further embodiment of a nose of a tubing shoe; and FIG. 12 is a side view of the embodiment of FIGS. 10 and 11.

Figure 1:
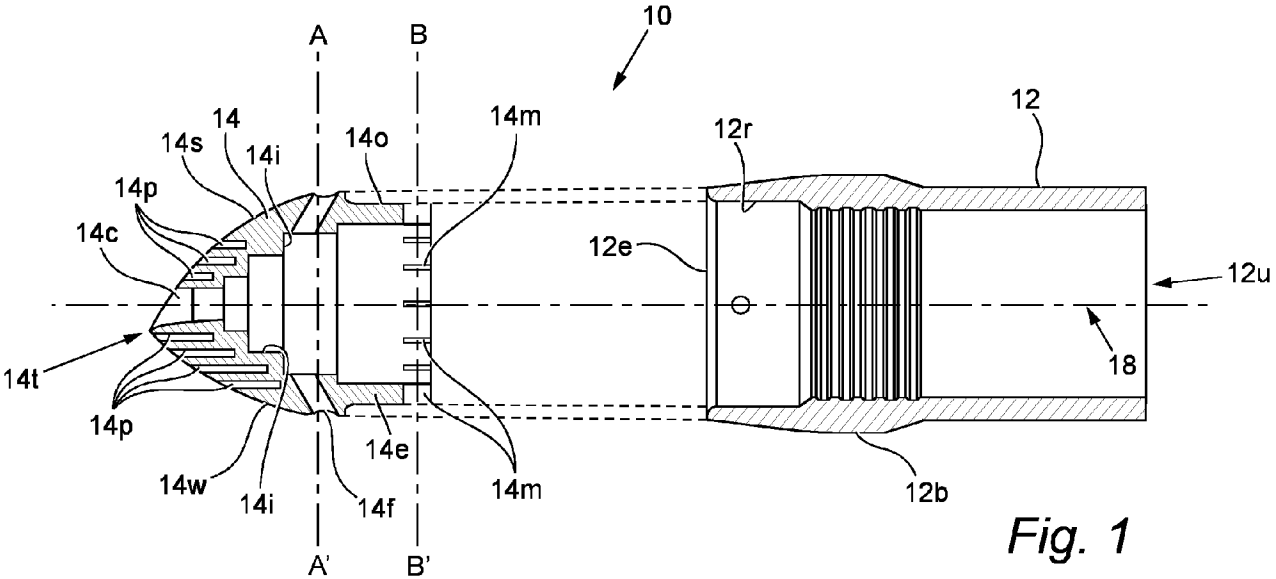
FIG. 1 is a sectional representation of a tubing shoe, including a main body and a nose cone shown in a disassembled configuration, according to an embodiment of the invention.
Figure 2:
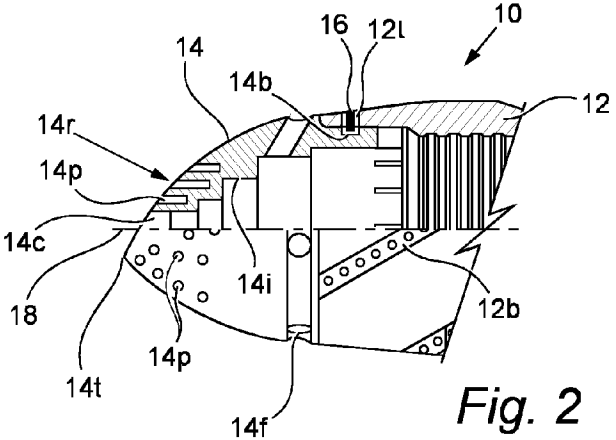
FIG. 2 is a ¾ sectional view of the tubing shoe of FIG. 1 with the body and nose cone shown in an assembled configuration.

A tubing shoe 10 has a main body 12 and a nose 14, as shown in FIG. 1 in a disassembled arrangement, for clarity. The tubing shoe is assembled for use as can be seen with further reference to FIG. 2, in which the nose 14 is fitted to an end 12*e* of the main body, which in turn is configured to be coupled to a tubing string (not shown) at an up-hole end 12*u* of the shoe.

In this example, the nose 14 is typically a unitary, generally hollow structure optionally formed from aluminium, and having a wall 14*w* which defines an outer surface 14*s* of the nose extending from the walls of the main body and tapering toward a nose tip 14*t*. A number of partial bores 14*p* are provided through the outer surface and into the wall 14*w* typically introducing discontinuities to the wall of the nose 14 that act to control break-up of the nose when it is to be drilled out from inside the shoe 10. The arrangement of discontinuities typically acts to limit the size of pieces broken off from the nose 14 as a result of the drill through process.

In terms of general structure of the tubing shoe, the nose 14 has a tubular end portion 14*e* which fits tightly into the bore of a complementary receiving section 12*r* of the main body, and is attached to the main body 12 by retaining pins 16. The retaining pins 16 are provided through locking holes 12*l* in the receiving section 12*r*, which are spaced circumferentially around the receiving section, so that the pins 16 engage with recessed slots 14*b* in an outer face 14*o* of the tubular end portion of the nose. The recessed slots 14*b* accommodate limited rotation of the nose with respect to the main body, around its central axis, to facilitate its running in the wellbore environment. The pins 16 also retain the nose 14 from axial displacement with respect to the main body.

The nose 14 typically has a generally conical shape, and in this example is an asymmetric frustocone. In this way, the nose cone is positioned at a leading end of the tubing shoe to facilitate running the tubing into the well to a tubing installation location.

Figure 3:
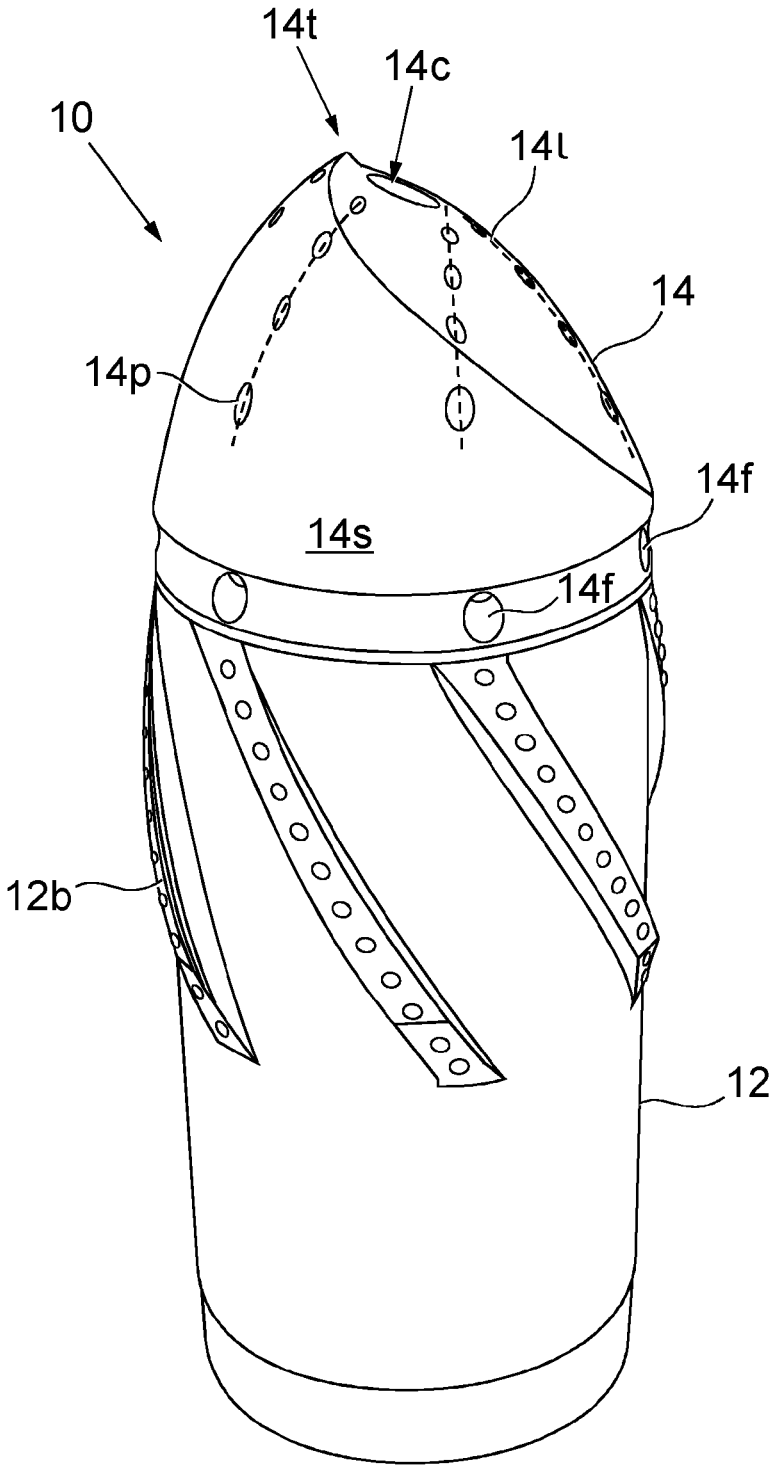
FIG. 3 is a perspective view of the tubing shoe of FIGS. 1 and 2.

In order to help run the tubing into the well, the shoe 10 has angled milling blades 12*b* on its outer surface which have cutting surfaces designed to cut into the well formation as the string is rotated and run into the well. In addition, the nose 14 is provided with circumferential fluid outlet ports 14*f* extending through the nose wall 14*w*. The arrangement of ports 14*f* is shown in FIG. 3 where the individual ports 14*f* form an angle with respect to the true radial direction of the tool. The ports 14*f* are directed backwards toward the up-hole end 12*u* so that fluid pumped through the ports 14*f* is typically directed backwards and upwards onto the blades 12*b* to help cool them during running in, and to clear them from debris. Flow channels are located between the blades 12*b* to facilitate upward flow of well fluids past the tool in the wellbore annulus (not shown) surrounding the shoe and the tubing.

The nose structure and arrangement of bores 14*p* is described now in more detail. The partial bores 14*p* of this example are aligned longitudinally, in parallel to a longitudinal axis 18 of the shoe, spaced apart from each other and the longitudinal axis 18. The partial bores 14*p* extend from openings in the outer surface 14*s* and terminate in the wall 14*w* a short distance from an inner surface of the wall 14*i* configured to be met by a drill bit upon being drilled through the nose.

The bores 14*p* and bore openings typically define subregions of the wall 14*w* between the bores 14*p*, governing the maximum size of the pieces which are able to break apart from the nose 14 when it is drilled out. The bores 14*p* are also typically arranged in groups or sub-sets of closely spaced bores, located in the wall in between the flow ports 14*f* and the central port 14*c*, to ensure that this region will tend to break into many small pieces. A limited distance from the inner wall to the terminated end of the partial bores 14*p* means that the drill bit (not shown) can engage the inner wall and readily penetrate to cause the nose 14 to fracture under control and guidance of the partial bores 14*p*.

In some embodiments, the terminated ends of the some of the partial bores can be arranged in the same plane, optionally in a manner that matches the outer surface of the drill bit to be used, so that the drill bit advancing through the nose 14 reaches a number (e.g. optionally all) of the terminated ends of the partial bores at the same time. The effect of this is that the regions bounded by the partial bores that are reached at the same time by the drill bit advancing through the nose will be weakened substantially as the bit moves into the partial bores, and preferential break up of that region will be more likely to occur at that point of the drill through process.

The inner surface 14*i* is also provided as a stepped surface which defines a succession of edges which present high pressure contact points for the drill bit. This helps the drill bit to bite into the nose piece and initiate break up of the nose more effectively. In addition, in FIG. 1 and also in FIG. 6, a number of circumferentially-spaced radial slots 14*m* are milled into the tubular end portion 14*e* toward an up-hole end 12*u*. This structure of the tubular end 14*e* is also designed to help break up of the nose 14 into small pieces when drilled out.

Figure 4:
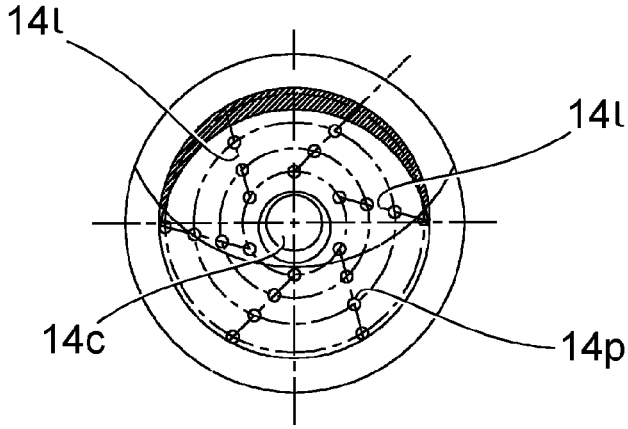
FIG. 4 is an end-on contour view of the tubing shoe of the above figures looking toward the nose cone.

In addition in FIGS. 3 and 4, the partial bores 14*p* of particular sub-sets of bores are spaced apart from each other at generally even intervals across the surface 14*s* and along pre-defined lines 14*l*. The respective lines 14*l* are typically oriented on intersecting directions angled with respect to each other. In contour view in FIG. 4, the bores 14*p* are also typically evenly spaced circumferentially around the nose 14, at different cross-sectional planes. The spacing between bores of a specific circumference decreases as the nose 14 tapers toward the tip 14*t*.

Figure 7:
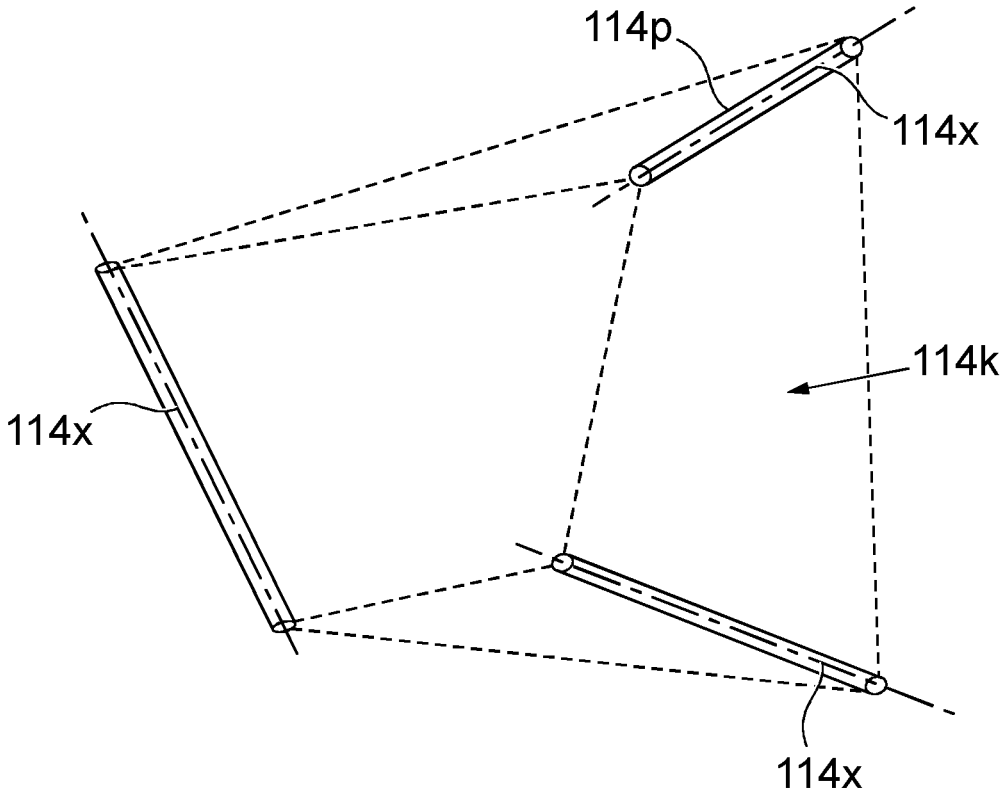
FIG. 7 is a schematic 3D representation of an arrangement of bores in a wall of a nose of a tubing shoe according to a further embodiment of the invention.

In other embodiments, the bores are distributed differently. FIG. 7 shows an example arrangement of bores 114*p* similar to the bores above, but where the bore axes 114*x* are oriented at different angles to each other. The bores 114*x* define a prismatic sub-block 114*k* in the wall of the nose 114, which is susceptible to break off in the form indicated, or to at least lead to break off of a piece that is dimensionally similar to that of the block defined between bores 114*p*. In this way, the positioning of bores 114*p*, and the definition of sub-regions of the nose controls how the nose will break up when drilled out.

Figure 8:
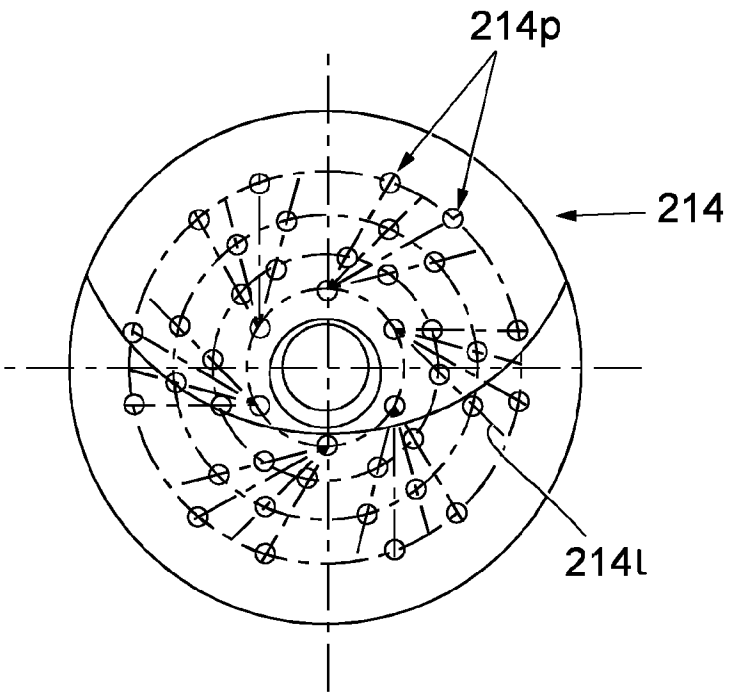

In the embodiment of FIG. 8, the bores 214*p* are similar to the bores 14*p* above but are more numerous and closer together than in the first example (contrast FIG. 4 with FIG. 8) and make the nose 214 more susceptible to break up into smaller pieces along the lines 214*l* than the nose 14. Accordingly the pattern of the bores can be changed to obtain a particularly desirable break-up behaviour from the nose 214.

Figure 9:
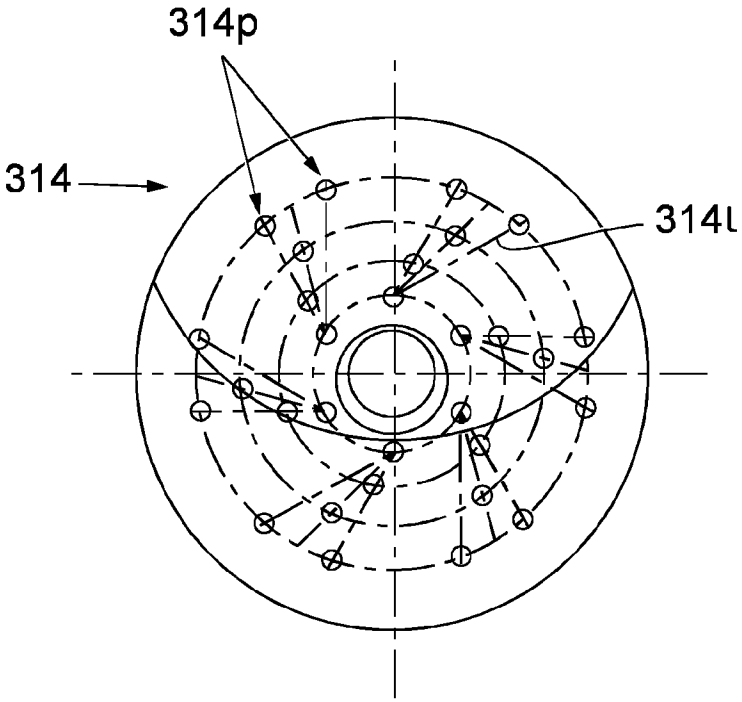
FIGS. 8 and 9 are end-on contour views similar to FIG. 4, looking toward the nose cone of two alternative tubing shoe noses having different patterns of failure guide structures.

In the embodiment shown in FIG. 9, the bores 314*p* are similar to the bores 14*p* above but the radial dispersion of the bores 314*p* is not uniform, and the bores 314*p* are more densely packed at the centre of the nose 314 than at the radial periphery (contrast FIG. 8 with FIG. 9) and this makes the nose 314 more susceptible to break up into smaller pieces along the lines 314*l* at the centre of the nose, which is often the main source of the larger pieces that tend to adversely affect drilling. Thus the pattern of the bores can be changed to influence whether larger pieces of the broken up nose are derived from the periphery rather than the centre. Of course the skilled person will understand that these examples are only illustrative, and other patterns can be used without departing from the scope of the invention.

A further embodiment of a nose 414 is shown in FIGS. 10-12. The nose 414 is adapted to connected to a body 12 as described for previous examples. The FIG. 10-12 embodiment has similar features to the previous embodiments, which are designated with the same reference number prefixed by "4". In the nose 414, the wall 414*w* is partly made up of an interlacing fracture mesh or web or lattice 414*l* formed by interlocking linear strips surrounding weakened areas or spaces, creating a honeycomb structure with the spaces or weakened areas supported between the linear strips of the lattice. The lattice 414*l* and optionally the whole of the nose 414 can optionally be cast, for example using lost wax casting procedures. The spaces or weakened areas in between the supporting strips of the lattice 414*l* provide discontinuities in the wall 414*w*. The lattice 414*l* presents an internal surface which is arranged to be met and penetrated by a drill bit, causing the lattice 414*l* to break up and thereby release small and discrete segments leading to break up of the nose.

Optionally the nose 414 is eccentric with one wall 414*w* thicker than the other, so that the drill bit which is aligned with the central axis 418 will penetrate through the outer surface 414*s* of the nose on one side (with the thinner wall) before the other, therefore retaining the tip 414*t* on the nose for longer during the drilling process, and increasing the grinding effect of the drill bit on the tip 414*t*.

In this embodiment, the fragment size can typically be substantially pre-determined on fabrication of the nose, and the lattice is typically designed to cooperate with the fragments to hold them together as required and release them in a generally predictable manner during drilling. The fragments can be small and regularly spaced, for example, like the regular interconnections between the strips of the lattice 414*l*, or can be formed as larger segments of the wall which can be themselves interconnected by lattice structures. In some cases, the lattice structure and fragment spacing can be irregular.

In some embodiments, the nose 414 can optionally have bores and/or slot discontinuities in the nose 414 similar to the bores 14*p* and similar in the previous embodiments, in addition to the lattice structure 414*l*. In various other embodiments, the lattice may form a discontinuity in the nose, and may be formed of a different material to the nose segments. However, in this embodiment, the lattice 414*l* may be formed from an intact web of the same material, from which the segments are pre cut or drilled or cast or otherwise machined or formed to fail at specific areas during the drilling process.

In some examples, through bores may be provided to penetrate completely through the nose cone wall instead of the partial bores, but in such embodiments the through bores would not be used primarily for fluid circulation. In addition, the bores may be replaced by slots or other discontinuities, and could be plugged with a different material, for example a plastics plug, to provide a discontinuity in terms of its material.

In use, the tubing shoe 10 with partial bores 14*p*, 114*p* formed in the nose cone wall 14*w* is typically attached to the main body 12 of the shoe 10, which in turn is typically attached to the tubing to be installed in the well. The tubing, with the tubing shoe at the leading end of the tubing string, is run into the well to a desired depth. The shoe circulates fluid into the well ahead of the string as it is introduced. The tubing is then secured in place in conventional fashion, typically by pumping cement into the annular wellbore space surrounding the tubing, which is then left to set.

Once installed, a drill string is run into the well through the inside of the tubing and drills out the nose 14 so that it can bore into the next section of the well downhole. As the drill bit engages an internal surface 14*i* of the nose 14 of the tubing shoe, it bites into it and causes it to fracture and break up. The partial bores which pierce into the outer surface and wall of the tubing shoe nose cone, act to guide the break up of the nose cone into pieces of debris limited in size as controlled by the bores, by virtue of their configuration, and arrangement in the nose wall 14*w* as described above. The nose debris from the broken nose is then readily washed out of the well with the drilling fluid used in the drilling process.

Embodiments of the present invention provide a number of advantages. In particular, break up of the tubing shoe nose is facilitated so as to reduce the time required to conduct the drill out operation. This in turn provides cost savings. In addition, it controls the size of the pieces of debris broken off the nose, reducing wear and interference of debris with the drilling bit as the drilling operation is progressed into the formation.

Various modifications and improvements can be made within the scope of the present invention described herein.

The invention claimed is:

1. A tubing shoe comprising:

a body adapted to be connected to a section of tubing to be emplaced in a wellbore;

a nose provided on the body; and wherein the nose includes a failure guide structure for controlling break-up of the nose upon being drilled out from inside the nose.

2. A tubing shoe as claimed in claim 1, wherein the failure guide structure limits the maximum size of pieces of the nose broken off upon drill out.

3. A tubing shoe as claimed in claim 1, wherein the failure guide structure defines weakened areas of the nose which are prone to fracture upon drilling.

4. A tubing shoe as claimed in claim 1, wherein the failure guide structure includes a region of discontinuity comprising at least one discontinuity formed in a wall of the nose, adapted to facilitate failure of the nose in the region of discontinuity when the nose is drilled.

5. A tubing shoe as claimed in claim 4, wherein the at least one discontinuity is in a form selected from the group comprising a slot, a bore, a partial bore, a puncture and/or a perforation.

6. A tubing shoe as claimed in claim 4, wherein the at least one discontinuity extends from an outer surface of the nose.

7. A tubing shoe as claimed in claim 4, wherein the wall of the nose has an inner surface and an outer surface, wherein the at least one discontinuity extends from one of the inner surface and the outer surface of the wall of the nose, partially into the wall of the nose, without reaching across to the other of the inner surface and the outer surface of the wall.

8. A tubing shoe as claimed in claim 4, wherein the at least one discontinuity comprises a blind ended bore.

9. A tubing shoe as claimed in claim 4, wherein the tubing shoe has a longitudinal axis, and wherein the at least one discontinuity has an axis substantially parallel to the longitudinal axis of the tubing shoe.

10. A tubing shoe as claimed in claim 4, wherein the failure guide structure has a plurality of discontinuities formed in the wall of the nose.

11. A tubing shoe as claimed in claim 10, wherein the plurality of discontinuities comprise a plurality of blind ended bores extending from an outer surface of the wall of the nose toward an inner surface of the wall of the nose, and wherein at least some of the plurality of blind ended bores terminate at a common axial depth of the nose, whereby a drill bit reaching this common depth in the nose of the shoe interconnects all discontinuities having the same depth of blind ended bores.

12. A tubing shoe as claimed in claim 10, wherein the plurality of discontinuities are arranged in the nose to define or delimit sub-regions of the nose, bounded, at least in part, by one or more of the discontinuities, whereby the nose is adapted to break-up into pieces of a size dependent on, determined by and/or corresponding to the size of the sub-regions.

13. A tubing shoe as claimed in claim 10, wherein one or more of the discontinuities have axes that are inclined with respect to the longitudinal axis of the tubing shoe.

14. A tubing shoe as claimed in claim 10, wherein two or more of the discontinuities have axes that are oriented along intersecting directions.

15. A tubing shoe as claimed in claim 10, wherein the discontinuities are arranged in sub-sets of discontinuities, with each member of each subset having a shared characteristic shape, depth, kind, length, orientation, alignment or position.

16. A tubing shoe as claimed in claim 15, wherein sub-sets of discontinuities are spaced apart along at least one straight or arcuate line on the nose.

17. A tubing shoe as claimed in claim 16, wherein the failure guide structure includes at least two subsets of discontinuities, and wherein one line is angled with respect to a second line, whereby the axes of the lines intersect.

18. A tubing shoe as claimed in claim 1, wherein the nose has a hollow nose body having an inner surface defining one or more steps.

19. A tubing shoe as claimed in claim 18, wherein the failure guide structure incorporates discontinuities in the form of partial bores extending at least part of the distance between an outer surface of the nose and the inner surface, and wherein the partial bores are positioned to align with the steps and/or step corners and/or step edges or faces of the inner surface, and wherein the partial bores terminate with an end of the partial bore spaced a pre-determined distance from the inner surface.

20. A tubing shoe comprising:

a body adapted to be connected to a section of tubing to be emplaced in a wellbore;

a nose provided on the body, wherein the nose includes a failure guide structure for controlling break-up of the nose upon being drilled out from inside the nose; and wherein the failure guide structure comprises a lattice web.

21. A tubing shoe comprising:

a body adapted to be connected to a section of tubing to be emplaced in a wellbore;

a nose provided on the body, wherein the nose includes a failure guide structure for controlling break-up of the nose upon being drilled out from inside the nose; and wherein the nose is eccentric around a central axis of the nose, so that a drill bit which is aligned with the central axis of the nose is guided by the central axis to penetrate through an outer surface of one side of the nose before the other.

22. A method of drilling a wellbore, the method comprising:

a. coupling a tubing shoe having a nose with failure guide structure to a tubing string;

b. running the string into a well to an installation location;

c. drilling out through the nose of the tubing shoe into the wellbore formation; and d. controlling break up of the nose via the failure guide structure.

* * * * *

UNITED STATES PATENT AND TRADEMARK OFFICE

CERTIFICATE OF CORRECTION

PATENT NO. : 8,657,036 B2
APPLICATION NO. : 13/143362
DATED : February 25, 2014
INVENTOR(S) : William Barron et al.

It is certified that error appears in the above-identified patent and that said Letters Patent is hereby corrected as shown below:

In the Claims:

Column 10, Claim number 20, Line number 36,

Replace "comprises a lattice web."
With -- comprises a web. --

Signed and Sealed this
Twenty-seventh Day of May, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,657,036 B2
APPLICATION NO. : 13/143362
DATED : February 25, 2014
INVENTOR(S) : Barron et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 285 days.

Signed and Sealed this
Twenty-ninth Day of September, 2015

Michelle K. Lee

Michelle K. Lee
*Director of the United States Patent and Trademark Office*